US008490788B2

(12) United States Patent
Perkins et al.

(10) Patent No.: US 8,490,788 B2
(45) Date of Patent: Jul. 23, 2013

(54) TACTICAL EQUIPMENT CARRIER

(75) Inventors: Timothy Perkins, Virginia Beach, VA (US); John D. Marcaccio, Mt. Airy, NC (US); Philip J. Ernst, Cana, VA (US)

(73) Assignee: Aerial Machine & Tool Corp., Meadows of Dan, VA (US)

( * ) Notice: Subject to any disclaimer, the term of this patent is extended or adjusted under 35 U.S.C. 154(b) by 153 days.

(21) Appl. No.: 13/087,965

(22) Filed: Apr. 15, 2011

(65) Prior Publication Data

US 2012/0261287 A1 Oct. 18, 2012

(51) Int. Cl.
*B65D 85/00* (2006.01)

(52) U.S. Cl.
USPC ..... 206/317; 224/913

(58) Field of Classification Search
USPC ..... 206/317, 314, 14, 315.11; 224/148.2, 224/150, 153, 257, 901.2, 902.4, 913; 42/96
See application file for complete search history.

(56) References Cited

U.S. PATENT DOCUMENTS

| | | | | | |
|---|---|---|---|---|---|
| 290,205 | A | * | 12/1883 | Bronson | 206/317 |
| 2,872,960 | A | * | 2/1959 | Kolpin | 206/317 |
| 2,901,018 | A | * | 8/1959 | Kolpin | 206/317 |
| 3,164,189 | A | * | 1/1965 | O'Link | 206/317 |
| 3,191,652 | A | * | 6/1965 | Benson et al. | 206/317 |
| 3,239,114 | A | * | 3/1966 | Norsworthy | 206/317 |
| 4,369,904 | A | | 1/1983 | Christensen | |
| 4,756,456 | A | | 7/1988 | Schauer | |
| 4,896,805 | A | * | 1/1990 | Klaczak et al. | 224/236 |
| 5,052,555 | A | * | 10/1991 | Harmon | 206/315.11 |
| D372,121 | S | * | 7/1996 | Rowe | D3/262 |
| 5,893,502 | A | * | 4/1999 | Redzisz | 224/577 |
| 6,109,442 | A | * | 8/2000 | Roegner | 206/581 |
| 6,119,907 | A | * | 9/2000 | Benjamin | 224/150 |
| 6,250,470 | B1 | * | 6/2001 | Mackenzie | 206/579 |
| D448,559 | S | | 10/2001 | Kolpin | |
| D448,560 | S | | 10/2001 | Kolpin | |
| 7,066,366 | B2 | * | 6/2006 | Hancock et al. | 224/401 |
| 7,434,683 | B1 | * | 10/2008 | Harper et al. | 206/315.11 |
| 7,905,350 | B2 | * | 3/2011 | Wood et al. | 206/317 |
| 2005/0011786 | A1 | | 1/2005 | Wood et al. | |
| 2008/0110076 | A1 | | 5/2008 | Bennett et al. | |
| 2009/0236378 | A1 | | 9/2009 | Crye | |

FOREIGN PATENT DOCUMENTS

JP 2002166894 6/2002

OTHER PUBLICATIONS

May 13, 2010, letter from U.S. Department of the Army Combat Development Directorate (Soldier Systems).
Military Specification MIL-C-10922G ("Case, Parachutist's Individual Weapons, M-1950, Adjustable"), Feb. 20, 1985.
Military Specification MIL-C-10922G ("Case, Parachutist's Individual Weapons, M-1950, Adjustable"), Feb. 20, 2985 (with drawings); date of handwritten note on first page unknown, date Feb. 20, 1985.
Photographs of M-1950 Parachutist's Weapons Case, date Feb. 4, 2011.
Web page downloaded from www.gunaccessories.com on Feb. 2, 2011.

* cited by examiner

*Primary Examiner* — David Fidei
(74) *Attorney, Agent, or Firm* — Banner & Witcoff, Ltd.

(57) ABSTRACT

A carrier for weapons and/or other tactical equipment can include a main body and an extension sleeve. The extension sleeve can be withdrawn so as to lengthen an internal storage region to, e.g., accommodate longer weapons.

10 Claims, 17 Drawing Sheets

TACTICAL EQUIPMENT CARRIER

BACKGROUND

Special warfare and special forces operators, as well as paratroopers and other military personnel, sometimes deploy by parachuting into an operational area. Law enforcement and other personnel may also deploy in this manner. When parachuting into an operational area, the parachutist typically carries weapons and other equipment. It is often desirable for the parachutist to contain weapons and equipment in some manner so as to ensure that needed weapons, ammunition and other equipment will not be lost during the jump, to prevent damage to weapons, and for other reasons.

Modern military and law enforcement personnel may use any of a large variety of weapons. The lengths and weights of those weapons can vary significantly. For example, an M4 carbine with a single magazine may weigh approximately 7.5 pounds and have a length of approximately 31 inches when its butt stock is collapsed. An M249 Squad Automatic Weapon (SAW) equipped with a standard butt stock weighs approximately 17 pounds (not including ammunition) and has a length of 41 inches. Numerous other weapons having various other lengths and dimensions are routinely used by military personnel. In addition to a weapon (or multiple weapons), a parachutist may also wish to carry extra ammunition and any of numerous other types of equipment. Examples of such equipment include bipods, tripods, weapon sighting devices, extra machine gun barrels, breaching tools, "hooligan" tools, etc.

As can be appreciated from the above description, any individual operator may potentially carry a combined weapon, ammo and equipment load that could be of substantially different length and weight relative to a load carried by another operator. Manufacturing a different type of weapon/equipment container for numerous weapon/equipment combinations would be impractical and could cause logistic problems. However, simply making one container large enough to carry the longest and heaviest combination of weapons and equipment is an incomplete solution. It is desirable for a weapons container to fit its contents relatively tightly so as to prevent articles in the case from banging against one another. It is similarly desirable to avoid use of a container that is excessively baggy and has large loose portions that can snag or otherwise interfere with a parachute drop.

One type of known weapon container used by military personnel during parachute jumps is the M-1950 parachutist's individual weapons case (as described by military specification MIL-C-10922G, dated 20 Feb. 1985). The M-1950 has been used for many years and predates many of the weapons used by modern military personnel. Although the M-1950 is somewhat adjustable, it suffers from various disadvantages when used with modern day weapons. For these and other reasons, there remains a need for improved containers that can be used by military and/or other personnel when deploying by parachute into a tactical environment.

SUMMARY

This Summary is provided to introduce a selection of concepts in a simplified form that are further described below in the Detailed Description. This Summary is not intended to identify key features or essential features of the invention.

In some embodiments, a carrier for weapons and/or other tactical equipment can include a main body and an extension sleeve. The extension sleeve is positioned so as to at least partially lie within an internal storage region of the main body. The sleeve can be withdrawn from the main body through an open end so as to lengthen the internal storage region by an amount of space inside a portion of the extension sleeve that extends beyond the main body.

In some embodiments, a carrier for weapons and/or other tactical equipment can include a main body and an interior partition. The partition is configurable to separate a weapon located in a first portion of an internal storage region of the carrier from equipment located in a second portion of the internal storage region. The partition may also include a pocket configured to hold at least a portion of a butt end of a weapon located in the first portion of the internal storage region. A snag-resistant surface can be included on one or more interior portions that confront a weapon when the weapon is contained in the internal storage region.

DETAILED DESCRIPTION

Figure 1A:
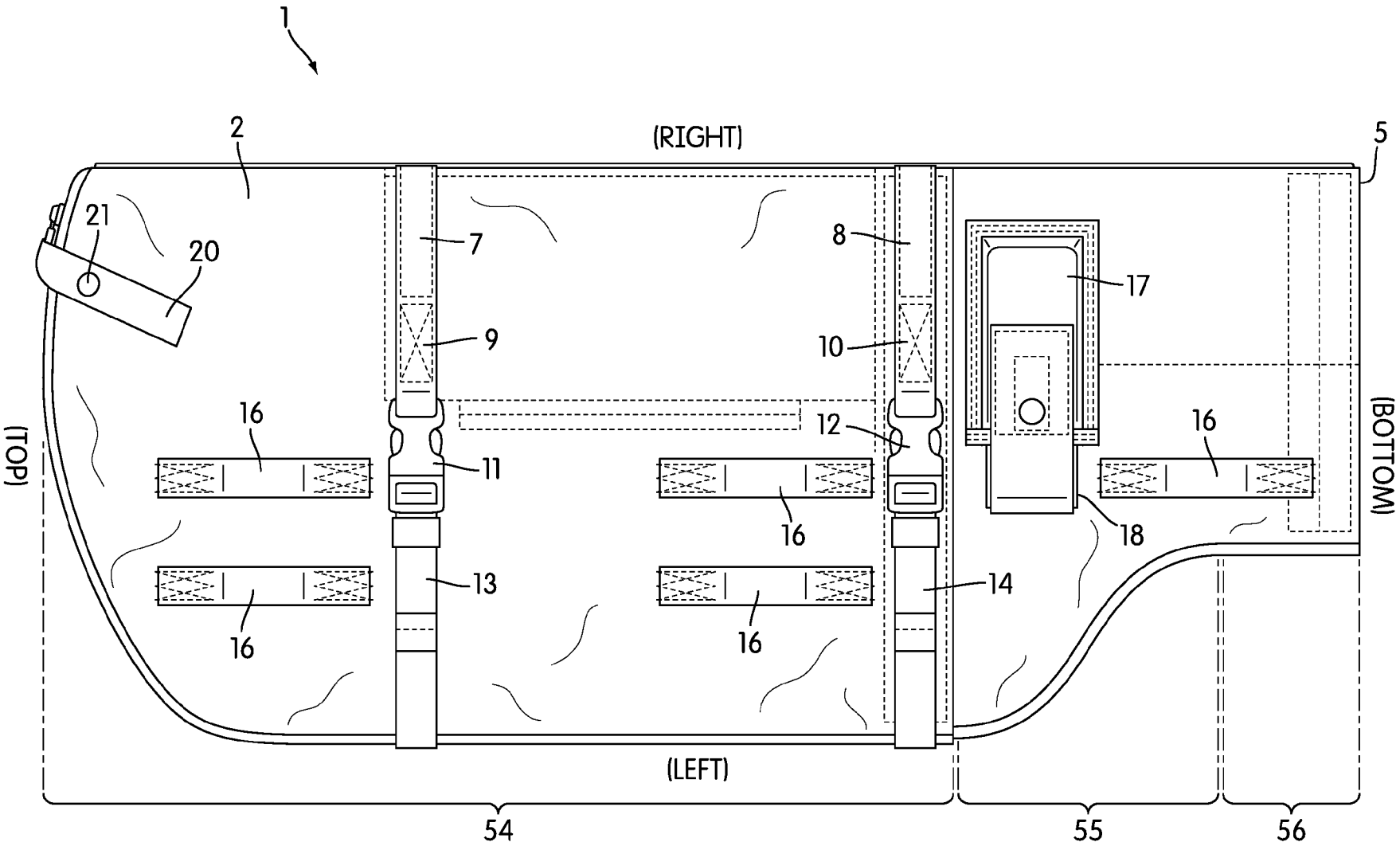
FIG. 1A is a front view of a tactical equipment carrier according to at least some embodiments.

FIG. 1A is a front view of a tactical equipment carrier 1 according to at least some embodiments. FIGS. 1B through 1E are left, top, right and bottom side views, respectively, of carrier 1. To avoid confusion, FIG. 1A includes labels indicating the sides of carrier 1 that will be referenced as left, top, right and bottom sides for purposes of the following description. Carrier 1 and carriers according to at least some additional embodiments are intended for use as a container for one or more weapons and/or for other tactical equipment during a parachute drop. However, carrier 1 and carriers according to other embodiments can also be used for other purposes and/or during operations other than parachute drops. As described in more detail below, various features of carrier 1 and of carriers according to some embodiments are adapted for coupling to a parachute harness or otherwise for securing the carrier in connection with a parachute drop. One or more of such features may be absent in carriers according to some embodiments.

As seen in FIGS. 1A-1E, carrier 1 includes a main body portion 2. A zipper 3 is located on the left side (FIG. 1B) and on the top side (FIG. 1C) of carrier 1. Zipper 3 allows panels forming the front and rear faces of main body 2 to be selectively attached. With zipper 3 closed, carrier 1 is in the closed condition shown in FIGS. 1A-1E. Subsequent figures show carrier 1 in an open condition (with zipper 3 separated) and are discussed below.

Figure 1B:
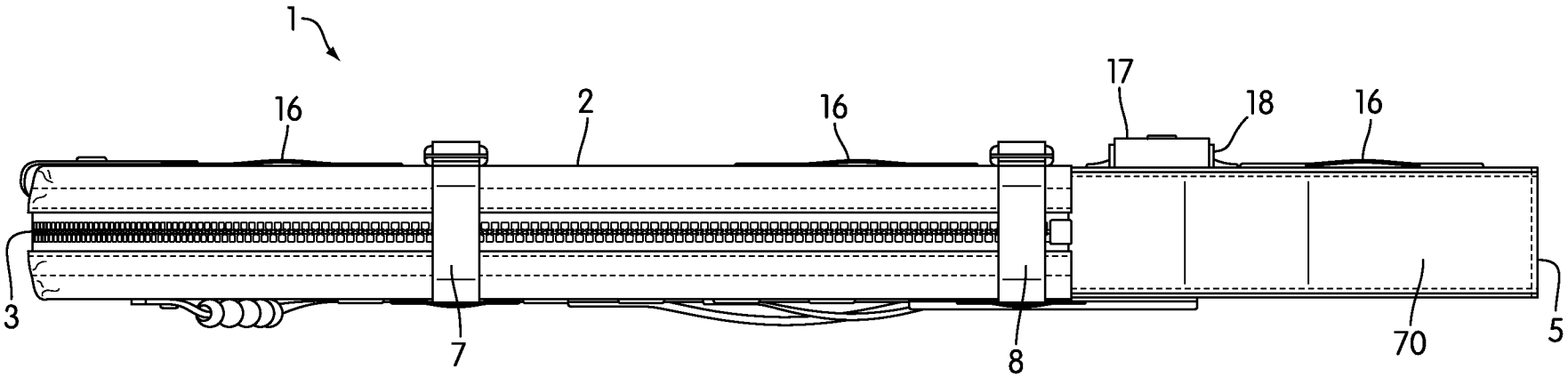
FIGS. 1B through 1E are left side, top side, right side and bottom side views, respectively, of the tactical equipment carrier of FIG. 1.
Figure 1C:
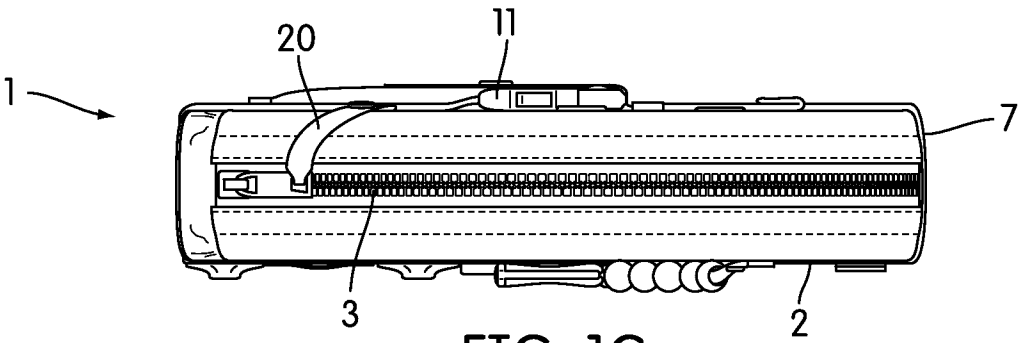
Figure 1D:
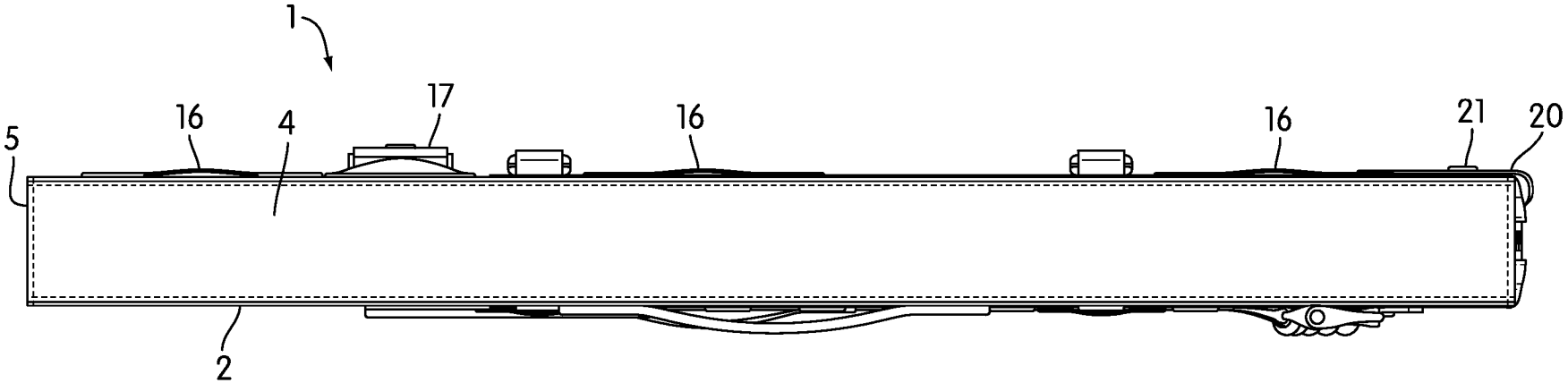

A reinforcing strip 4 of heavy duty nylon webbing is attached to the right edge of carrier 1 (FIG. 1D). Strip 4 helps provide additional tensile strength and wear resistance along the length of carrier 1.

Figure 1E:
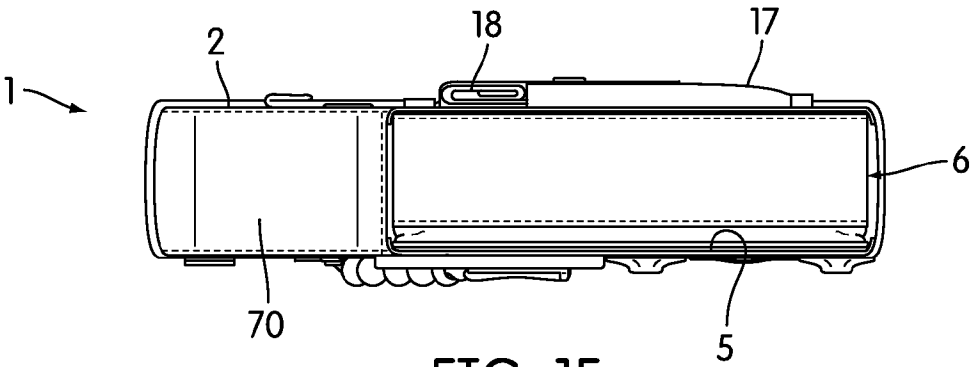

As seen in FIG. 1E, main body 2 includes an open end 5. An extendable sleeve 6 rests within main body 2 and is exposed by open end 5. As explained in more detail below, sleeve 6 can be extended from opening 5 so as to lengthen an internal storage space of carrier 1 and accommodate longer weapons. FIGS. 1A through 1E show carrier 1 in a shortened configuration in which sleeve 6 is fully withdrawn into main body 2.

Figure 1F:
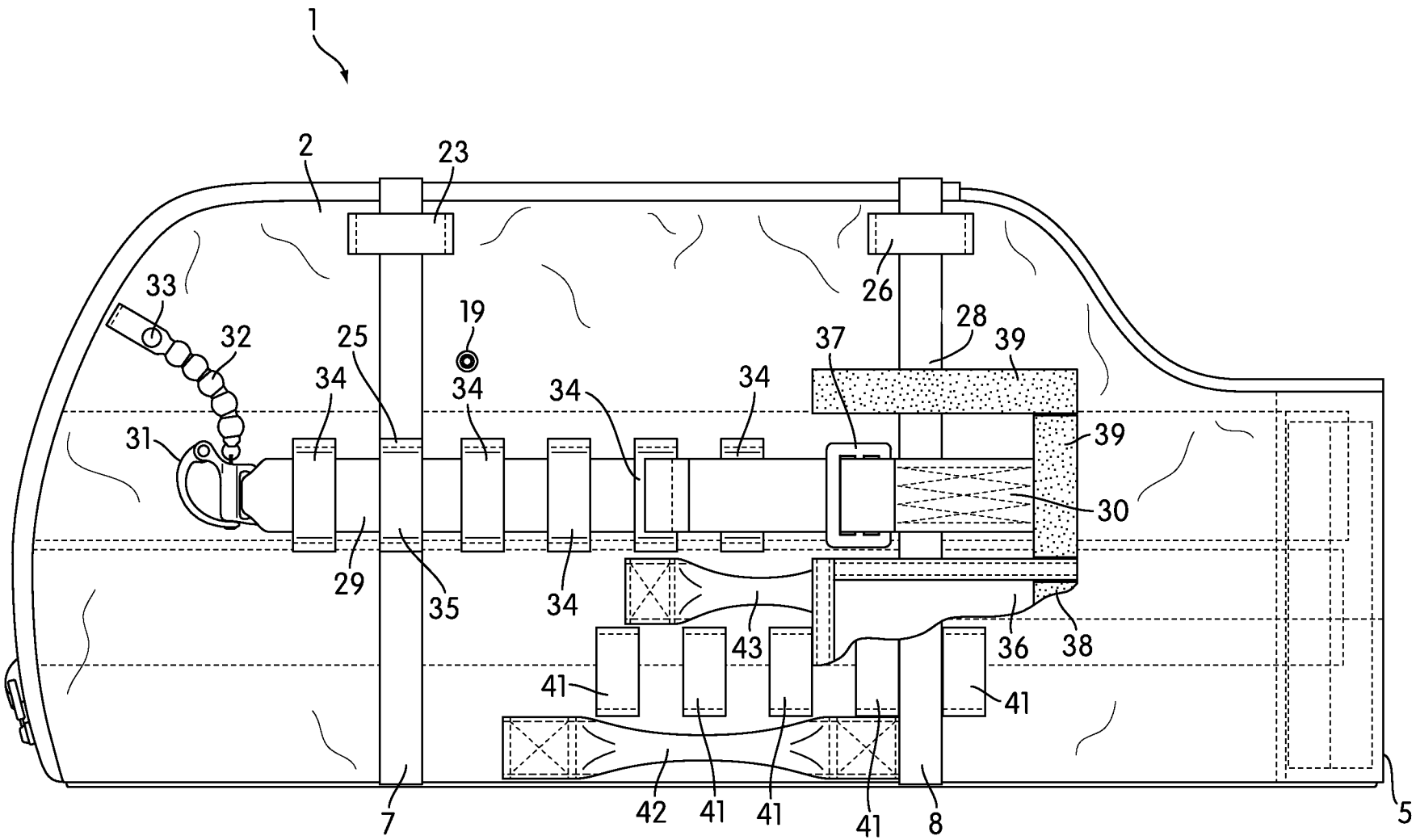
FIG. 1F is a rear view of the tactical equipment carrier of FIG. 1.

As seen in FIGS. 1A, 1B and 1F, carrier 1 includes two cinching straps 7 and 8. Each of straps 7 and 8 wraps completely around main body 2 and is sewn or otherwise attached to main body 2 along much of its length. A portion of strap 7 between the attachment point 9 (near adjustable side-release buckle 11) and a corresponding location on the rear of carrier 1 is not sewn to main body 2. Similarly, a portion of strap 8 between the attachment point 10 (near adjustable side-release buckle 12) and a corresponding location on the rear of carrier 1 is not sewn to main body 2. Buckles 11 and 12 can be disconnected and the disconnected ends of straps 7 and 8 moved so as to allow opening of main body 2 when halves of zipper 3 are separated. Buckles 11 and 12 can then be reconnected after weapons and/or other equipment has been placed into carrier 1 and halves of zipper 3 have been rejoined to close main body 2. Straps 7 and 8 can be cinched by pulling on free ends 13 and 14 emanating from buckles 11 and 12. This cinching shortens the straps and reduces the overall width of carrier 1, as is discussed in more detail below in connection with FIG. 10.

As seen in FIGS. 1A and 1B, the front of carrier 1 includes five tie-down loops 16. Each of loops 16 is sewn to main body 2 at its ends so as to provide a loop through which straps or line can be passed. This facilitates securing of carrier 1 to an operator or in another location. A closeable pouch 17 holds a leg strap 18 that can be withdrawn from pouch 17 and wrapped around a parachutist's leg. A snap (not shown) on the end of strap 18 can be attached to snap 19 (FIG. 1F) on the rear of carrier 1. Leg strap 18, only a portion of which is visible in FIGS. 1A and 1E, can be formed from a strip of nylon webbing and can include corresponding patches of hook and loop fastening material for adjustment purposes and/or as an alternate means of securing strap 18 around a jumper's leg. A lanyard 20 for a pull tab on the slider of zipper 3 is releasably secured to a top corner of main body 2 with a snap 21 that attaches to a mating snap on the front of main body 2.

In some embodiments, carrier 1 has an external length of approximately 32.5 inches when in the shortened configuration of FIG. 1 and has an external uncinched width of approximately 14 inches in the region of straps 7 and 8. Such embodiments can be configured to carry any of a variety of weapons that include (but are not limited to) the following: an M4 carbine, an M249 Squad Automatic Weapon (SAW) with a collapsible butt stock, an M110 semiautomatic sniper rifle, an M16 assault rifle, or an M249 SAW with a standard butt stock. In other embodiments, carrier 1 may have an external length of approximately 42 inches when in the shortened configuration of FIG. 1 and have an uncinched width at straps 7 and 8 of approximately 16 inches. Such other embodiments can be configured to carry a variety of longer weapons that can include (but that are not limited to) any of the following: an M249 SAW with a standard butt stock, an M60 machine gun, an M24 sniper weapon system, an M14 enhanced battle rifle, an M240 machine gun, and an M107 long range sniper rifle.

FIG. 1F is a rear view of carrier 1. Except for a belt loop 23 located near the left side of main body 2, strap 7 is not attached to main body 2 between attachment point 25 and attachment point 9 shown in FIG. 1A. Similarly, and except for a belt loop 26 also located near the left side of main body 2, strap 8 is not attached to main body 2 between attachment point 28 and attachment point 10 shown in FIG. 1A.

An adjustable parachute harness attachment strap 29 is located on the rear of main body 2. A lower end 30 of strap 29 is sewn to main body 2 near the bottom end of main body 2. An upper end of strap 29 is attached to a quick-release shackle 31. A release lanyard 32 for shackle 31 is secured to main body 2 with a snap 33. Intermediate portions of strap 29 between shackle 31 and end 30 are restrained by belt loops 34 and by a belt loop 35 formed from a portion of strap 7. A cover 36 can be secured over adjustment buckle 37 of strap 29 by attaching hook material strips 38 on the underside edges of cover 36 to loop material strips 39 on main body 2. A portion of cover 36 has been removed in FIG. 1F. Cover 36 helps to prevent buckle 37 from snagging on other straps, lines, etc. during a parachute jump.

The rear of main body 2 also includes five PALS (pocket attachment ladder system) webbing loops 41 to hold a lowering line. One end of that lowering line can be attached to carrier 1 and another end attached to the harness of a parachute jumper. During a parachute jump, the jumper can release carrier 1 from the jumper's harness prior to landing. This allows carrier 1 to be suspended from the descending jumper by the lowering line, and to hit the ground before the jumper lands. This reduces the weight of one jumper's legs when the jumper hits the ground.

As also seen in FIG. 1F, webbing handles 42 and 43 can be attached to main body 2. These handles can also be used as tie-down loops similar to loops 16 of FIG. 1. Additional handles and/or tie down loops could be included elsewhere on the exterior of carrier 1.

Figure 2A:
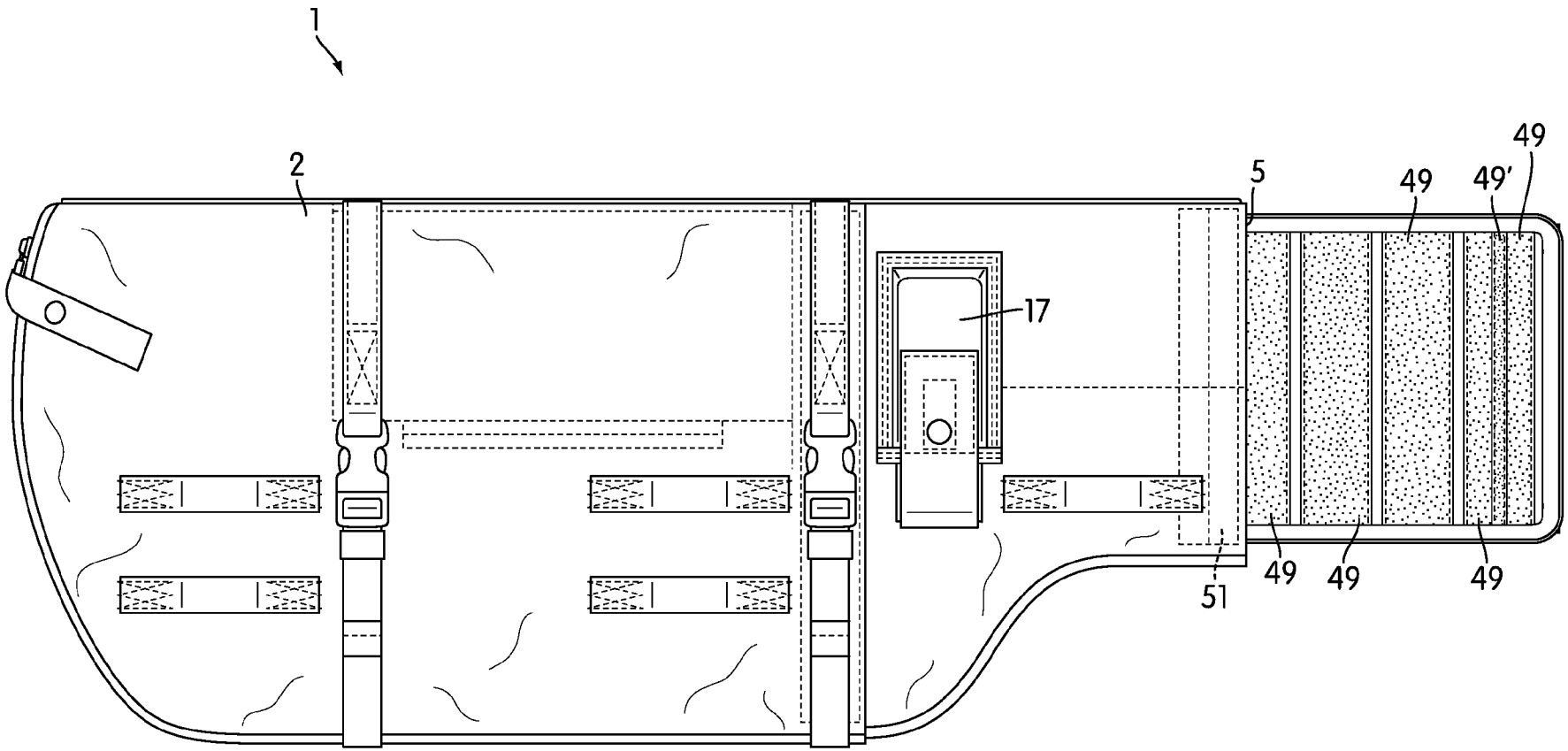
FIGS. 2A and 2B are respective front and rear views of the tactical equipment carrier of FIG. 1, but with an extension sleeve extended from the bottom of the main body.
Figure 2B:
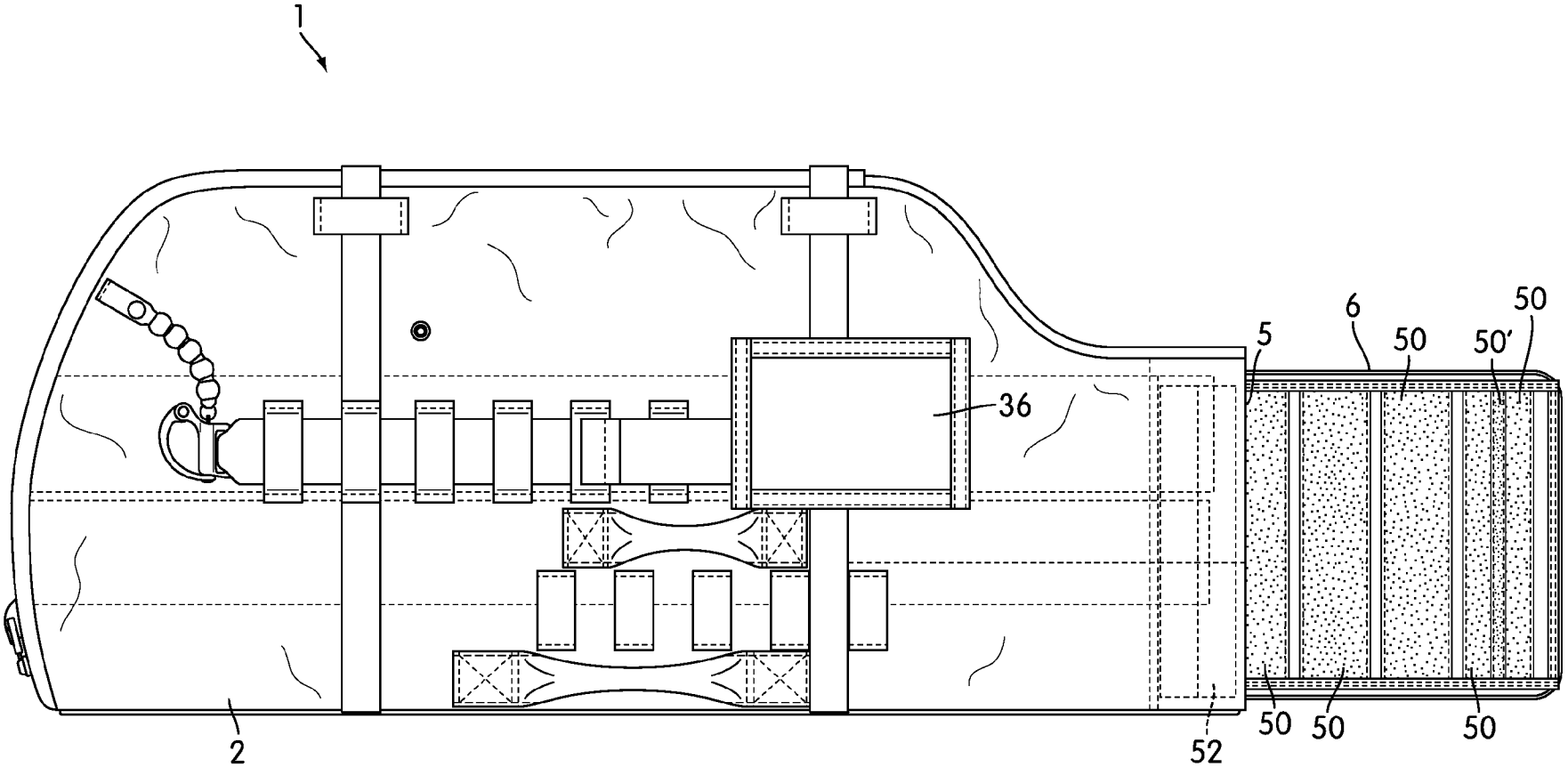

FIGS. 2A and 2B are respective front and rear views of carrier 1 in an extended configuration. Extension sleeve 6 has been withdrawn from open end 5 of main body 2. In this extended configuration, carrier 1 can accommodate longer weapons and/or other equipment. Carrier 1 could alternately be placed into numerous configurations between the configuration of FIGS. 1A-1F and the configuration of FIGS. 2A and 2B by extending sleeve 6 less than the amount shown in FIGS. 2A and 2B. In the above-mentioned embodiments in which carrier 1 has an external length of approximately 32.5 inches when in the shortened configuration of FIG. 1, carrier 1 has an external length of approximately 41.5 inches when extension sleeve 6 is fully withdrawn from main body 2. In the above-mentioned embodiments in which carrier 1 has an external length of approximately 42 inches when in the shortened configuration of FIG. 1, carrier 1 has an external length of approximately 53 inches when extension sleeve 6 is fully withdrawn from main body 2.

As seen in FIG. 2A, extension sleeve 6 has multiple bands 49 of loop fastening material attached to its front. The bottom and top bands 49 may include differently colored strips 49'. As seen in FIG. 2B, sleeve 6 also includes multiple similar bands 50 of loop material on its rear. The bottom and top bands 50 may also include differently colored strips 50'. A strip 51 of hook material is attached to the front inner edge of main body 2 adjacent open end 5 (FIG. 2A), and another strip 52 of hook material is attached to the rear inner edge of main body 2 adjacent open end 5 (FIG. 2B). Strips 51 and 52 cooperate with various of bands 49 and 50 so as to help maintain sleeve 6 in a desired amount of extension from main body 2. Strips 49' and 50' allow for easy positioning of sleeve 6 (relative to main body 2) so as to accommodate common weapons.

Figure 3:
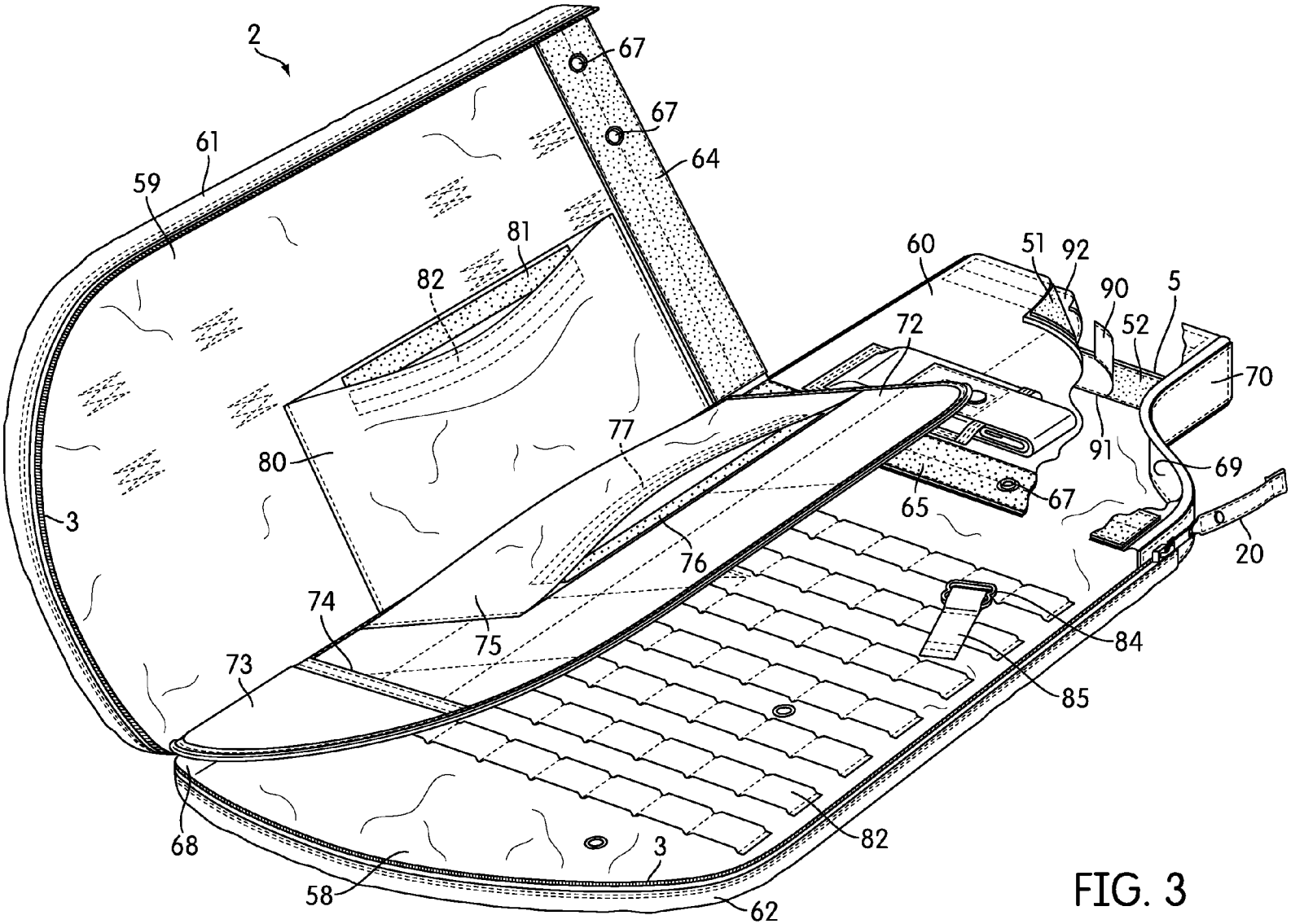
FIG. 3 is a perspective, partial cutaway view of the main body of the tactical equipment carrier of FIG. 1.

FIG. 3 is a perspective view of the main body 2. As explained in more detail below in connection with FIG. 9, a separate nylon curtain sewn to sleeve 6 and to main body 2 may prevent sleeve 6 from being completely withdrawn from main body 2. Sleeve 6 and that curtain have been removed in FIG. 3, and a portion of main body 2 around open end 5 has been cut away, so as to show additional detail of main body 2.

As shown in FIG. 1A, main body 2 includes a broadened region 54, a narrow region 56 adjacent open end 5, and a transitional region 55 between regions 54 and 56. The rear boundary of main body 2 is formed by a rear panel 58 that spans the entire rear of main body 2. The front boundary of main body 2 is formed by a top front panel 59 and a bottom front panel 60. Panel 59 spans broadened region 54. Panel 60 spans transition region 55 and narrow region 56. Left and top edges of panel 59 include an attached lip 61 to which one half of zipper 3 is attached. The other half of zipper 3 is attached to a lip 62, with lip 62 attached to left and top edges of rear panel 58. A strip 64 of loop fastening material is attached to the inside of top front panel 59 along a bottom edge. A strip 65 of hook material is attached to bottom front panel 60 along an outside upper edge. Strip 65 cooperates with strip 64 to secure an edge of panel 59 to an edge of panel 60. Snaps 67 can also be included to further secure panel 59 to panel 60.

Rear panel 58 is inseparably joined along the right side of main body 2 to a right side panel 68. Only a small portion of the inside face of right side panel 68 is visible in FIG. 3. As seen in FIG. 1D, webbing strip 4 is attached to the outside of right side panel 68. Right edges of top front panel 59 and of bottom front panel 60 are also inseparably joined to right side panel 68. A portion of the left side of rear panel 58 and the left side of bottom front panel 60 are inseparably joined to left side panel 69. A strip 70 of heavy duty nylon webbing (similar to the material of strip 4 in FIG. 1D) is attached to the outside of left side panel 69.

In some embodiments, panels of main body 2 can be formed from one or more sheets of woven nylon material. Closed cell foam can be placed between inner and outer nylon sheets used to form a panel and secured in place with quilting stitches. Main body 2 can be assembled in any of various manners. In some embodiments, for example, rear panel 58, top front panel 59, bottom front panel 60, right side panel 68 and left side panel 69 can all be formed as separate elements and then stitched together. Lips 61 and 62 could then be sewn on, strips 4 and 70 sewn in place, etc. As another example, rear panel 58, right side panel 68 and one of top panels 59 or 60 could all be fabricated as a single panel, and then folded and/or stitched in appropriate locations so as to define rear panel 58, right side panel 68, and one of top panels 59 or 60. The remaining panels could then be separately fabricated and attached, lips 61 and 62 attached, strips 4 and 70 attached, etc. Numerous other techniques could also be used.

Main body 2 further includes an interior partition 72 attached to rear panel 58 and right side panel 68. Partition 72 can be formed from two sheets of woven nylon material having an interposed layer of padding (e.g., ¼" closed cell foam) between them. The front face of partition 72 includes a corner pocket 73 that is open along its lower edge 74. As explained in more detail below, pocket 73 can be used to hold the butt of a weapon stock. Partition 72 also includes a supplemental padding pouch 75. Pouch 75 can be opened and closed on one edge using strips 76, 77 of hook and loop fastening material. A similar pouch 80 is located on an inner surface of top front panel 59. Pouch 80 can similarly be opened and closed with strips 81, 82 of hook and loop material. Pouches 75 and 80 are positioned so as to respectively lie under and above an optical weapon sight, a thermal weapon sight, or other type of sighting component that might be attached to a weapon stored within carrier 1. Supplemental padding as needed can be placed in either or both of pouches 75 and 80 so as to provide additional protection for sensitive weapon sighting components.

The inner face of rear panel 58 includes multiple Molle (or PALS) loops 82 attached in broadened region 54. Loops 82 can be used to secure ammunition clips, breaching tools, or other equipment within the internal storage cavity of carrier 1. Partition 72 can then be laid over equipment attached to loops 82 and thereby protect a weapon located on the front of partition 72.

Buckle 84 is attached to the inner face of rear panel 58 by a short piece of strap 85. Although not visible in FIG. 3, a similar buckle 86 is attached to the inner face of rear panel 58, near the right side, with a piece of strap 87. Buckle 86 and strap piece 87 can be seen in FIG. 5A. Buckle 84 is used to tighten or slacken a strap 88 of sleeve 6 (see FIG. 4A). Buckle 86 is used to tighten or slacken a strap 89 of sleeve 6. As discussed below in connection with FIG. 4C, straps 88 and 89 are attached to the rear of extension sleeve 6 and can be tightened so as to limit the amount by which sleeve 6 extends from opening 5.

As seen in the cutaway portion of FIG. 3, hook material strip 52 can be covered by a piece of nylon webbing 90 that is sewn to the inside rear of main body 2 along one edge 91 of strip 52. A similar piece 92 of nylon webbing is sewn to the inside front of main body 2 along one edge of hook material strip 51 located adjacent the front inner edge of opening 5. These nylon webbing covers can be rolled back so as to expose the hook material strips and allow those strips to connect to loop material strips 49 and 50 of sleeve 6. The nylon webbing covers can be rolled over the hook material strips when sleeve 6 is being withdrawn from or pushed into main body 2 so as to allow easier movement of sleeve 6 when configuring carrier 1.

Figure 4A:
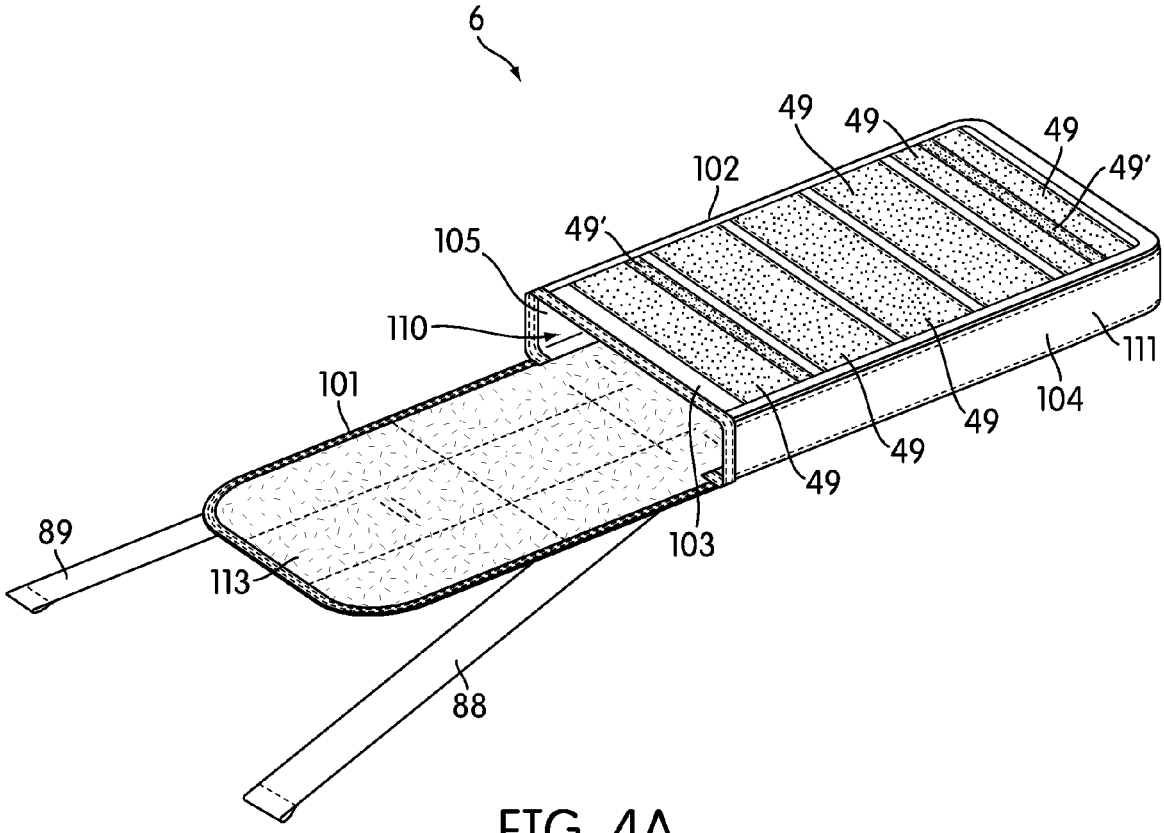
FIG. 4A is a perspective view of the extension sleeve of the tactical equipment carrier of FIG. 1.

FIG. 4A is a front, forward left perspective view of extension sleeve 6 removed from main body 2. Sleeve 6 includes a base 101 and a pocket 102 formed around the lower end of base 101. Pocket 102 includes a front panel 103, a left panel 104, a right panel 105 and a bottom panel (not visible in FIG. 4A) that are stitched or otherwise joined to one another and to base 101. A mouth 110 exposes the interior of pocket 102. Except for mouth 110, pocket 102 is completely enclosed. Each of the panels of pocket 102 can be formed from woven nylon material sheets that sandwich padding (e.g., closed cell foam) or other supporting material. A strip 111 of heavy duty nylon webbing can be attached to left panel 104, right panel 105 and the bottom panel so as to prevent pocket 102 from collapsing.

Figure 4B:
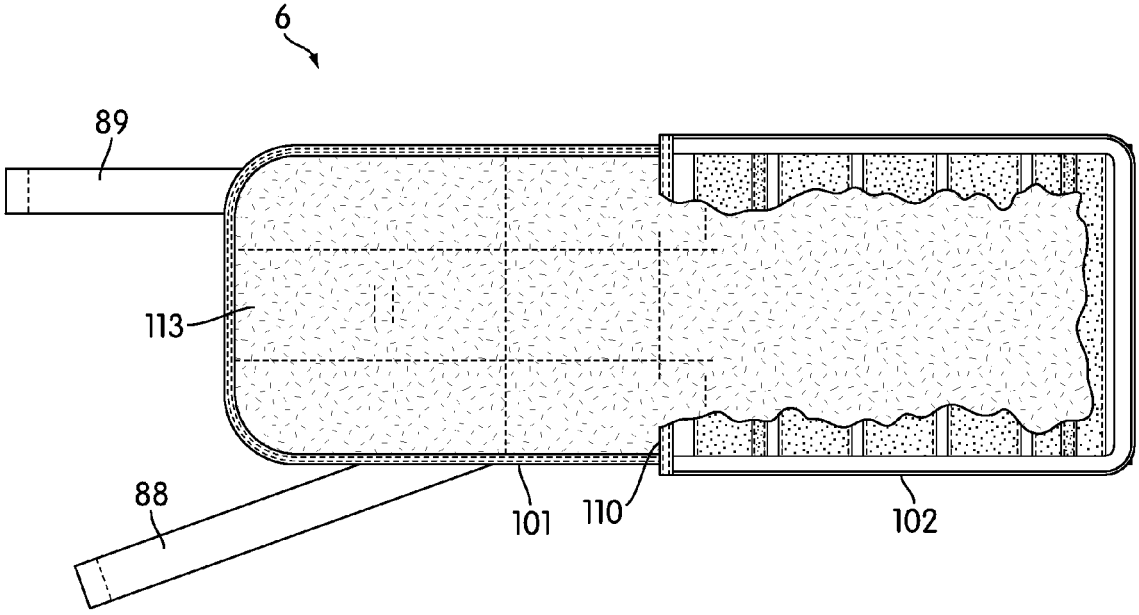
FIG. 4B is a top cutaway view of the extension sleeve of FIG. 4A.

FIG. 4B is a front view of sleeve 6 in which a portion of pocket 102 has been cut away. Base 101 includes a rear panel 112 of woven nylon (FIG. 4C) and a front panel 113 formed from a material that resists snagging and is smoother than nylon materials used for other portions of carrier 1. The snag-resistant nature of panel 113 helps to prevent snagging of various elements located on a weapon (e.g., a front sight, a bipod) when that weapon is being removed from carrier 1. In some embodiments, front panel 113 is formed from Duck Cloth Nylon (also known as ballistic cloth). A layer of ⅛" closed cell foam can be placed between rear panel 112 and front panel 113 so as to stiffen base 101. In some embodiments, snag-resistant material can also be placed on interior surfaces of front panel 103, left panel 104, right panel 105 and the bottom panel of pocket 102.

Figure 4C:
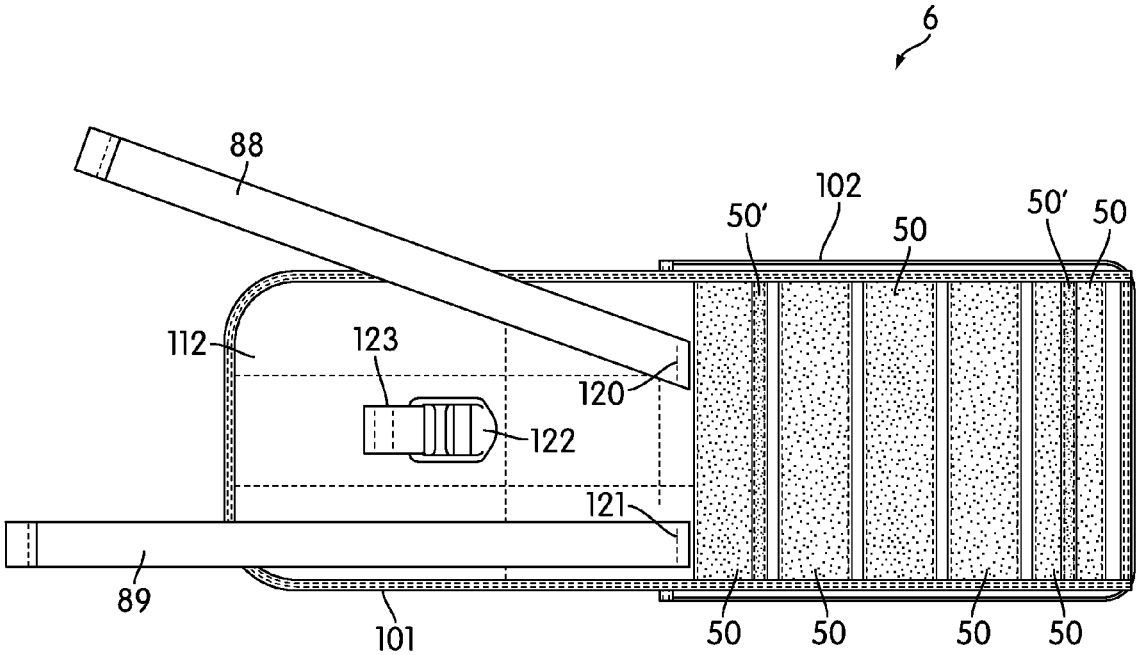
FIG. 4C is a rear view of the extension sleeve of FIG. 4A.

FIG. 4C is a rear view of sleeve 6. An end 120 of strap 88 is attached to the rear of base 101. The other end of strap 88 is threaded through buckle 84 (FIG. 3) when carrier 1 is assembled. An end 121 of strap 89 is also attached to the rear of base 101. The other end of strap 89 is threaded through buckle 86 (FIG. 5A) when carrier 1 is assembled. A buckle 122 is attached to the rear of base 101 by a short strip 123 of strap material and is used to tighten a third strap described in connection with FIG. 9.

Figure 5A:
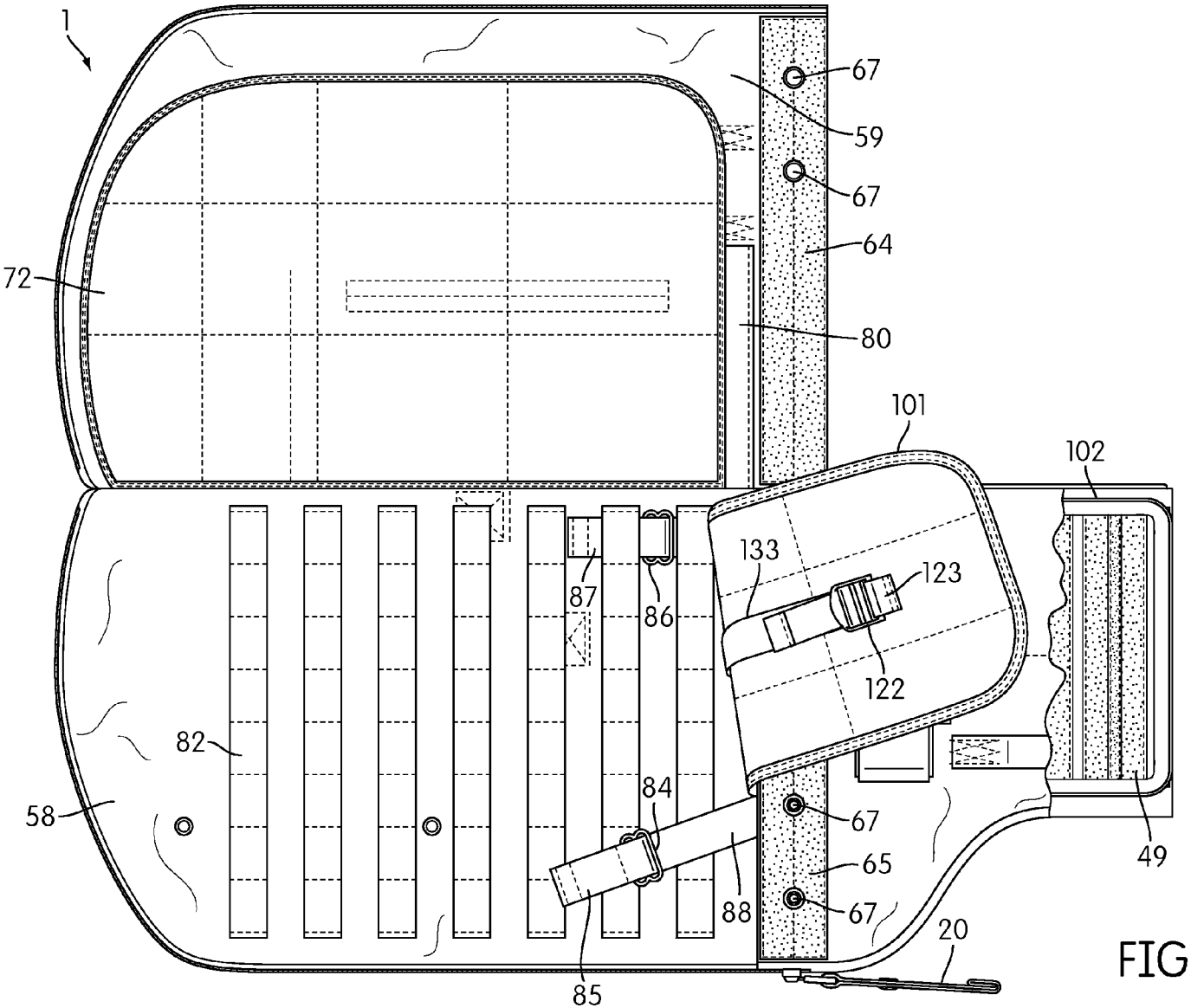
FIGS. 5A-5C are front views of the tactical equipment carrier of FIG. 1 in various open conditions.
Figure 5B:
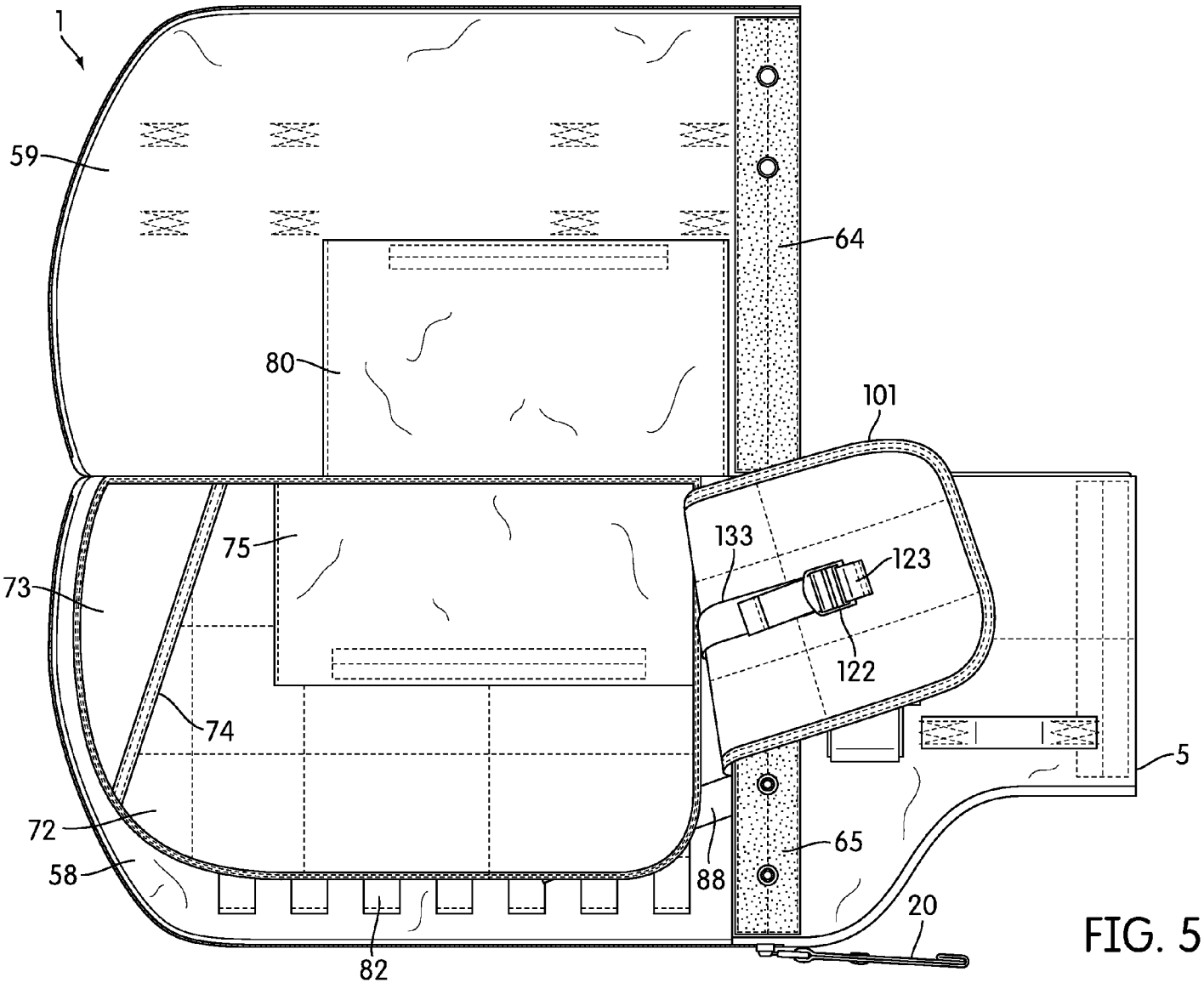
Figure 5C:
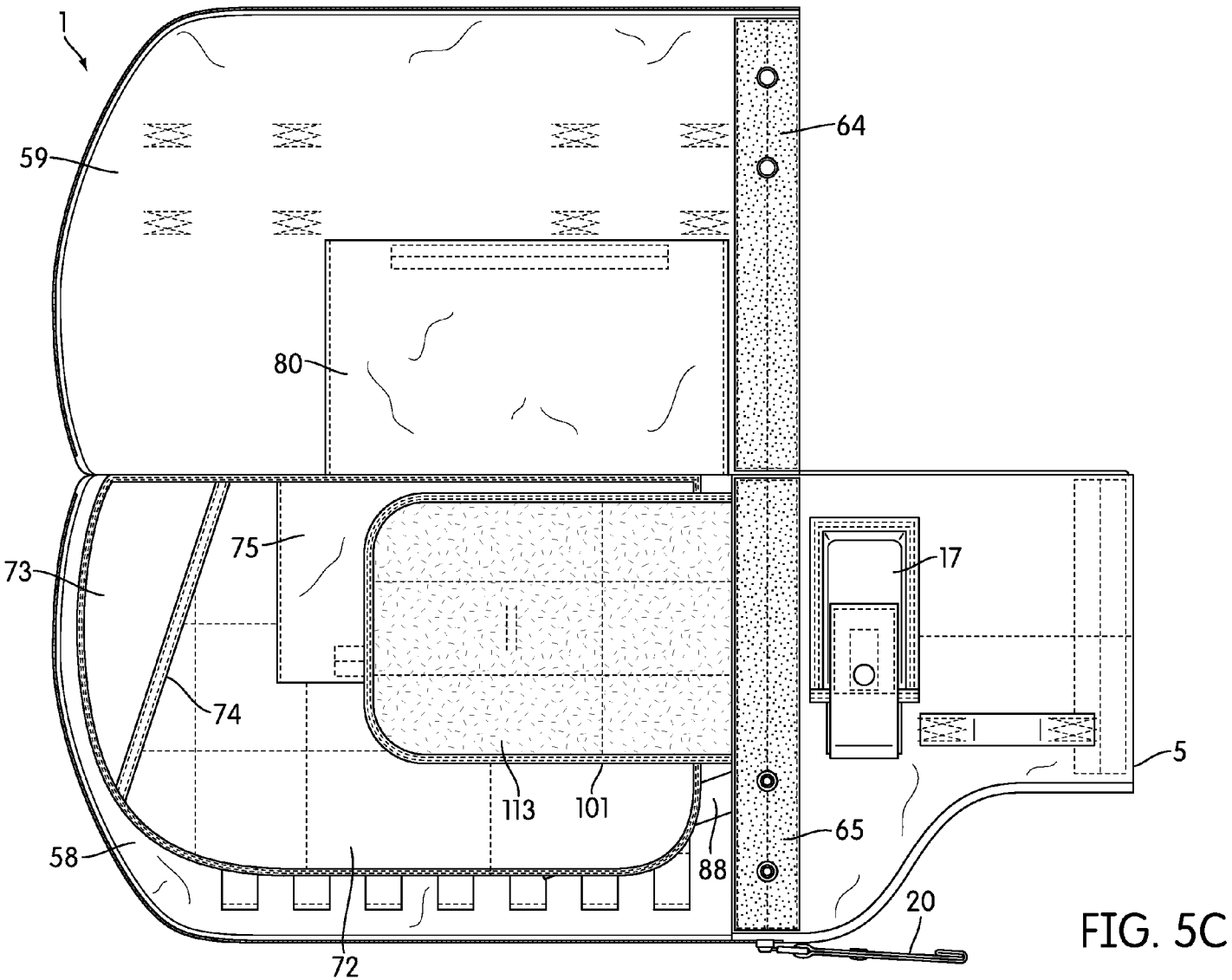

FIGS. 5A through 5C are front views of carrier 1 in a shortened configuration, and in various open conditions, that illustrate how various elements may be manipulated so as to access different parts of the carrier 1 internal storage space. A portion of the bottom front of main body 2 has been removed in FIG. 5A to show the position of sleeve 6 in the shortened configuration. In FIG. 5A, partition 72 has been lifted up and base 101 of sleeve 6 has been pulled back over transitional region 55 of main body 2. An operator could place carrier 1 into this condition so as to secure ammunition magazines and other equipment to various of loops 82. In some cases, that other equipment could include a breaching tool (e.g., a hooligan tool), a secondary weapon, or other equipment having a length that extends into transitional region 55 or into transitional region 55 and narrowed region 56. Such equipment could be placed so as to rest between the inner face of rear panel 58 and the underside of sleeve 6 (i.e., the bottom of base 101). In this manner, equipment stored in one portion of carrier 1 could be separated from a weapon resting within pocket 102 of sleeve 6.

FIG. 5B shows partition 72 folded down so as to cover the inner face of rear panel 58 and any equipment secured to loops 82. FIG. 5C shows base 101 folded down over partition 72. In the condition shown in FIG. 5C, carrier 1 is now ready to receive a weapon into a storage space that will include the interior region of main body 2 once carrier 1 is closed. That storage space also includes the interior region of pocket 102 of sleeve 6. In the configuration of FIG. 5C, the interior region of pocket 102 coincides with a portion of the interior region of main body 2. In extended configurations, however, and as discussed more fully below, some or all of the interior region of pocket 102 will lie beyond opening 5, thereby extending the storage space of carrier 1 by the amount of the pocket 102 interior no longer coinciding with the main body 2 interior.

Figure 6:
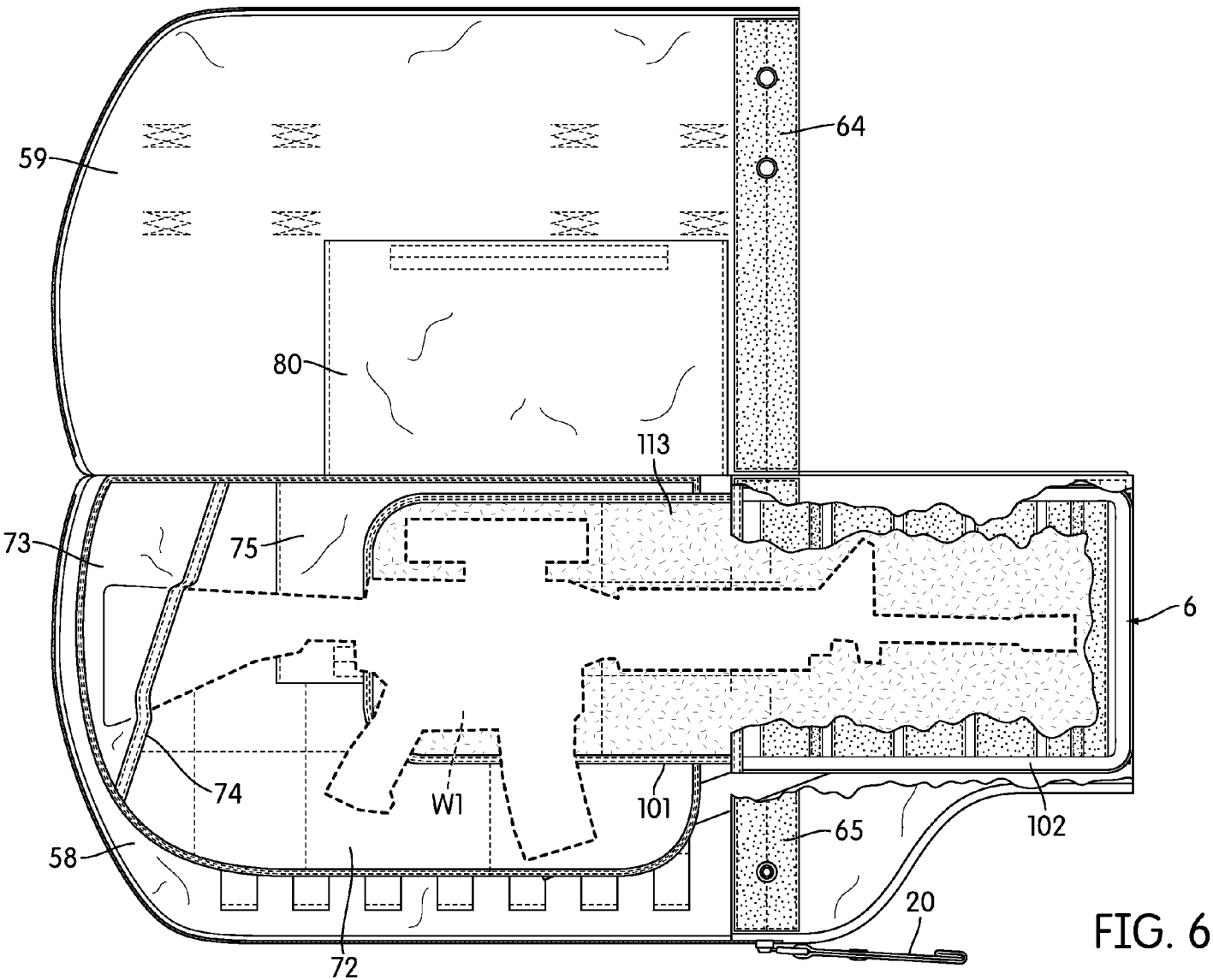
FIG. 6 is a front partial cutaway view of the tactical equipment carrier of FIG. 1 in a shortened configuration and open condition, and showing the location of a first weapon.

FIG. 6 illustrates one example of a weapon W1 placed into carrier 1. Portions of main body 2 and of sleeve 6 have been cut away to show the location of various portions of weapon W1 within carrier 1. As also seen in FIG. 6, pocket 73 is used to hold the butt of weapon W1. In the example of FIG. 6, weapon W1 is an M4 carbine with a daytime telescopic sight. This is only one example of the weapons that can be stored in carrier 1. A wide variety of different weapons could be placed into carrier 1, and numerous configurations of each of such weapons could be accommodated. For example, weapon W1 could alternatively be an M4 carbine with a thermal imaging or other type of sighting component, could include a different type of butt stock, could include a forward handle or an attached grenade launcher, etc.

Figure 7:
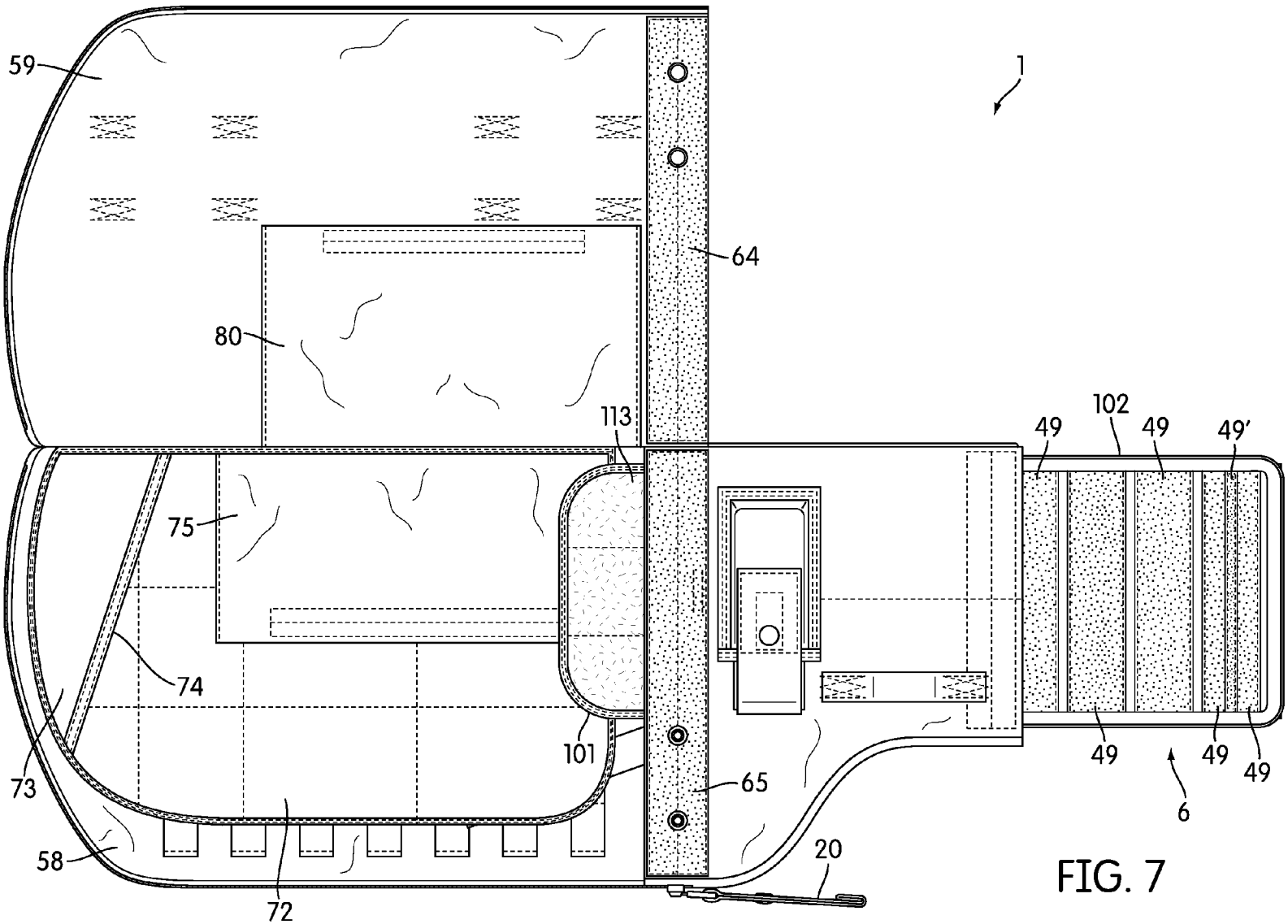
FIG. 7 is a front view of the tactical equipment carrier of FIG. 1 in an extended configuration and open condition.
Figure 8:
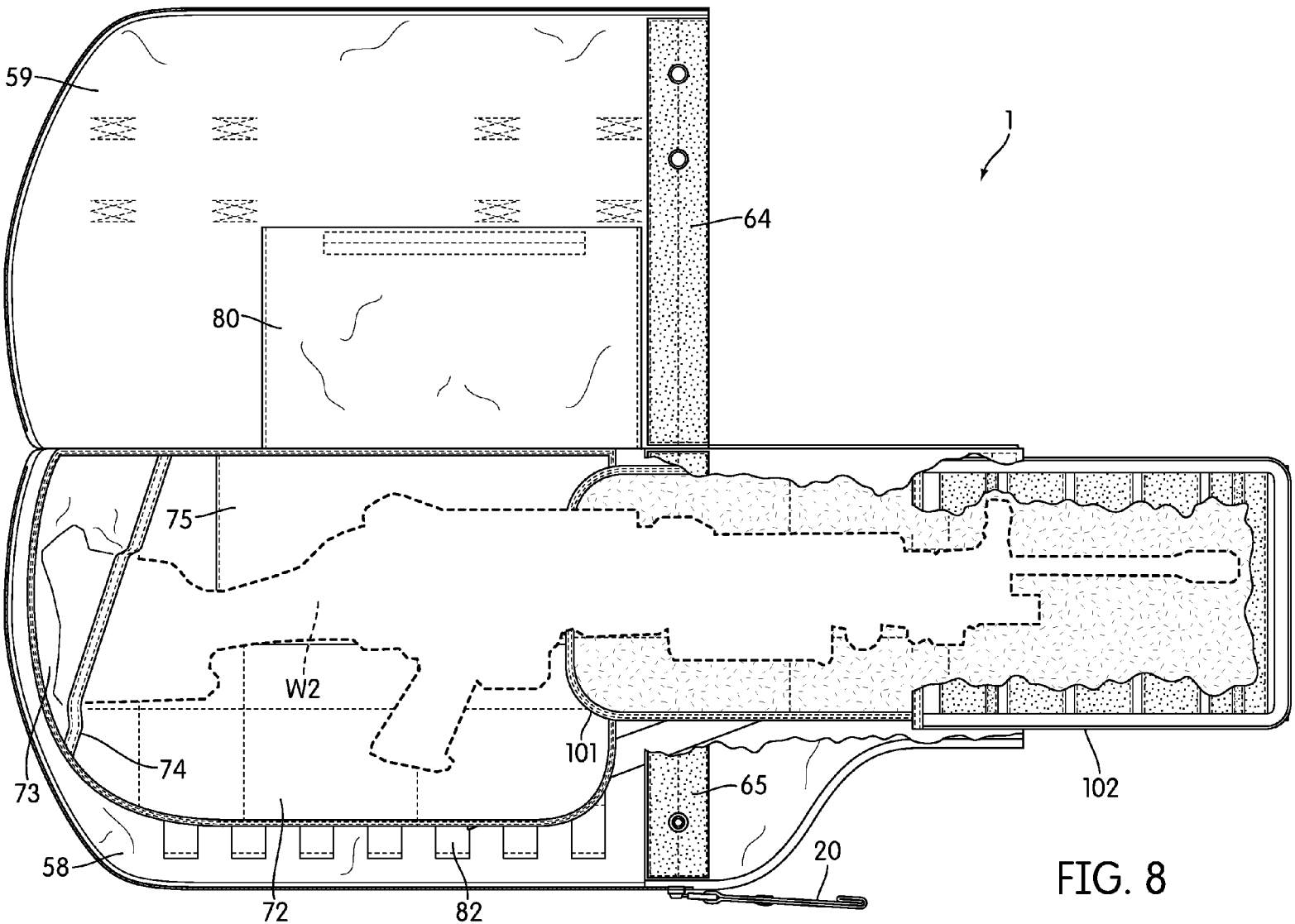
FIG. 8 is a front partial cutaway view of the tactical equipment carrier of FIG. 1 in an extended configuration and open condition, and showing the location of a second weapon.

FIG. 7 is a front view of carrier 1 in an extended configuration and in an open condition. Sleeve 6 has been withdrawn from opening 5. In the configuration of FIG. 7, the interior portion of pocket 102 that extends beyond opening 5 augments the storage space provided by the interior region of main body 2. This allows carrier 1 to accommodate longer weapons and/or other equipment. For example, and as shown in FIG. 8, a weapon W2 longer than weapon W1 has been placed into carrier 1. Similar to FIG. 6, portions of main body 2 and of sleeve 6 have been cut away. In the example of FIG. 8, weapon W2 is an M249 SAW with a standard butt stock. The butt of weapon W2 is secured by pocket 73. As with FIG. 6, weapon W2 is only one example of a weapon (and of a particular configuration for that weapon) that can be accommodated by carrier 1 in the extended configuration of FIGS. 7 and 8 or in other extended configurations.

Figure 9:
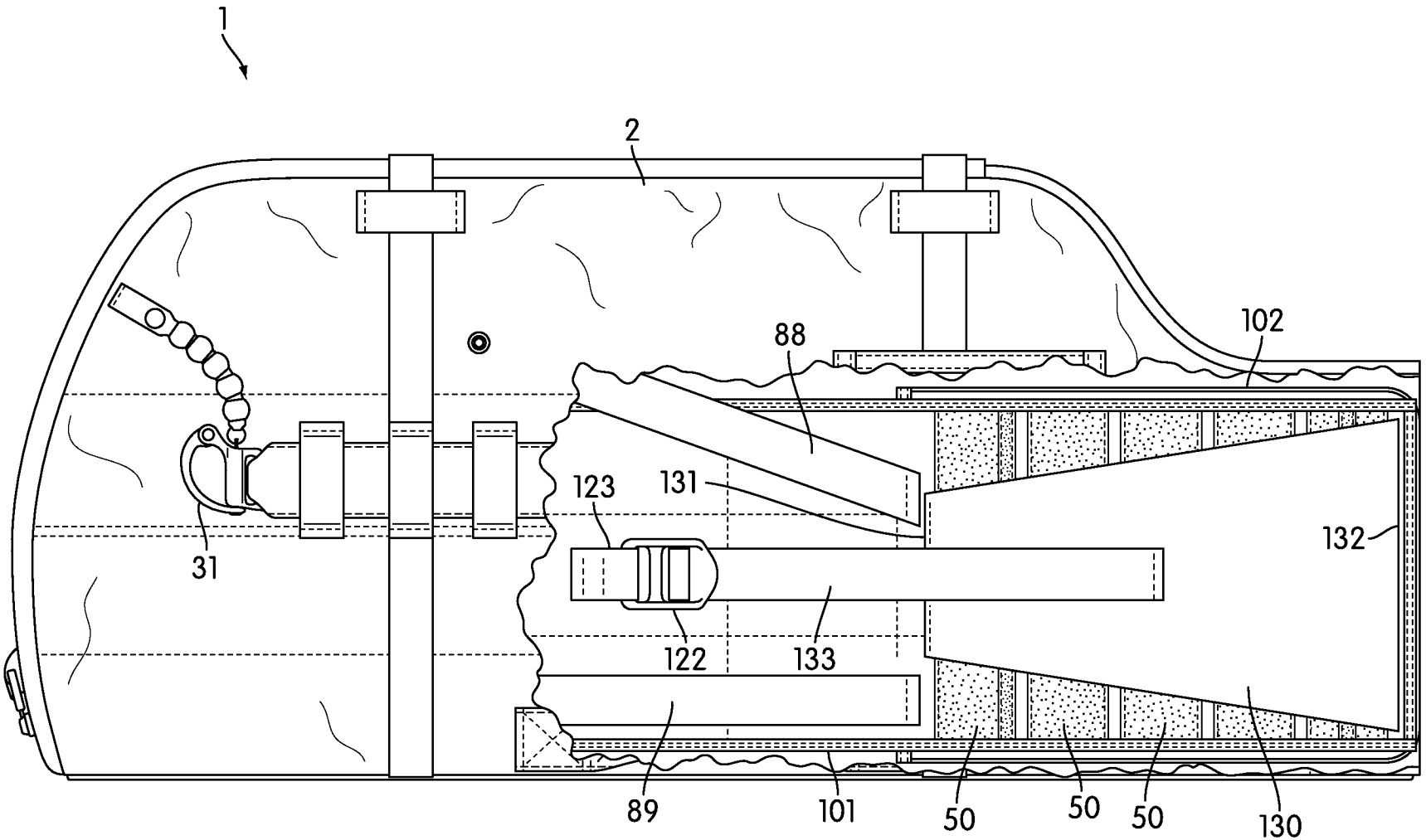
FIG. 9 is bottom partial cutaway view of the tactical equipment carrier of FIG. 1.

FIG. 9 is a rear view of carrier 1 in which a portion of main body 2 has been cut away to reveal the manner in which sleeve 6 can be installed in main body 2. A trapezoidal curtain 130 formed from a sheet of woven nylon material is connected to the rear of sleeve 6 and to the inner face of rear panel 58. A first edge 131 of curtain 130 is sewn to base 101 along a line near the attachments of straps 88 and 89 to base 101. A second edge 132 of curtain 130 is attached to the inner face of rear panel 58 near opening 5. A strap 133 has one end attached to curtain 130 approximately at mid length of curtain 130. The other end of strap 133 is threaded through buckle 122.

Curtain 130 serves to prevent sleeve 6 from inadvertently becoming separated from main body 2. Curtain 130 also helps to prevent equipment stored between the underside of sleeve 6 and the inner face of rear panel 58 from slipping out of opening 5. Strap 133 can be tightened or loosened at buckle 122 so as to prevent curtain 130 from escaping out of opening 1. Strap 133, straps 88 and 89, and the interaction of loop panels 49 and 50 with hook panels 51 and 52 operate to secure sleeve 6 at a desired amount of extension from main body 2.

Figure 10:
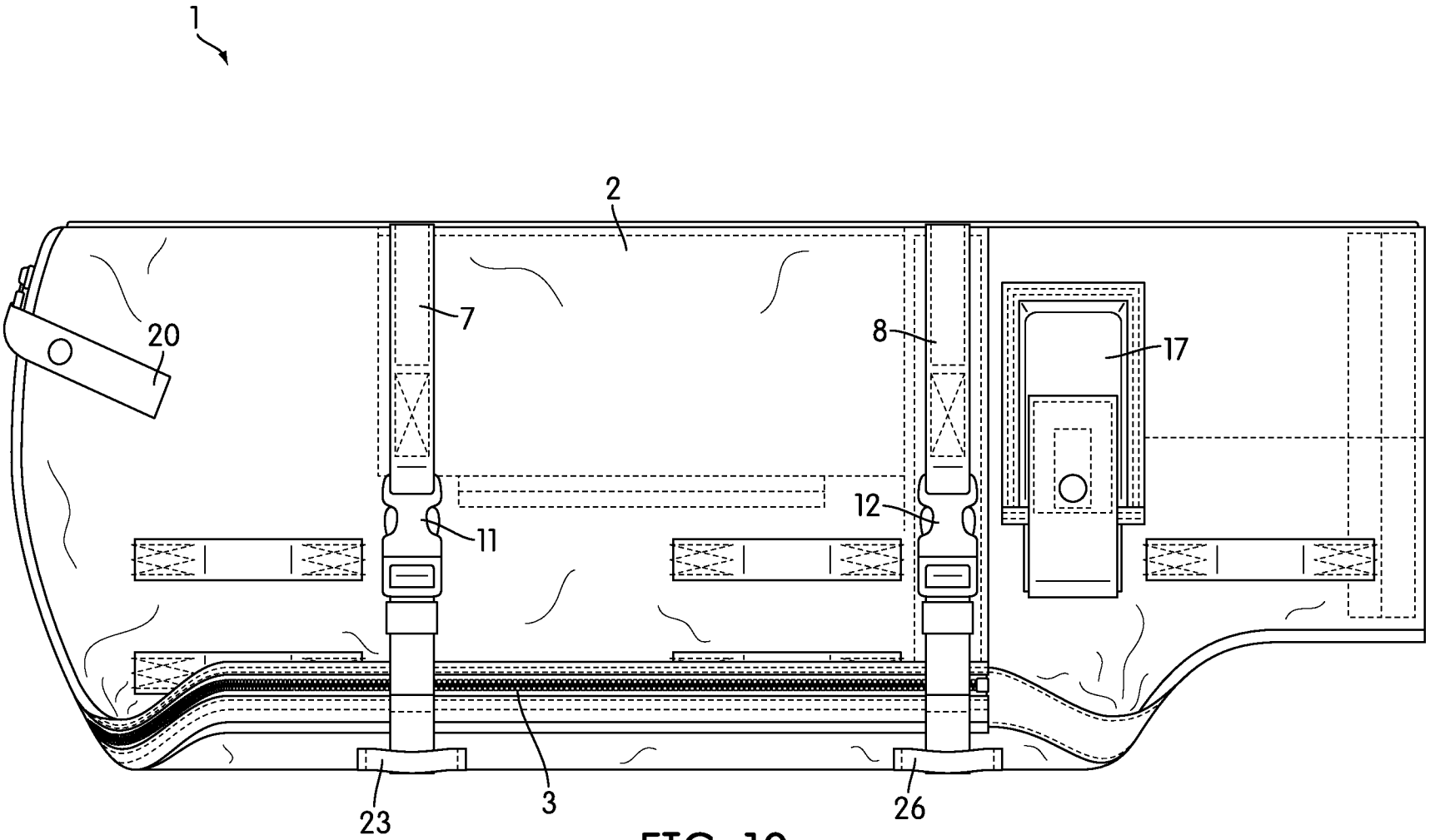
FIG. 10 is a top view of the tactical equipment carrier of FIG. 1 in a shortened and cinched configuration.

Once a weapon (and/or other equipment) has been placed into carrier 1 (e.g., as shown in FIGS. 6 and 8), top front panel 59 can be folded down and the halves of zipper 3 connected so as to place carrier 1 in a closed condition. Cinching straps 7 and 8 can then be used to collapse excess interior space of carrier and more closely conform carrier 1 to a weapon and other equipment contained therein. This is shown in FIG. 10.

A carrier according to some embodiments may not include all features described above in connection with carrier 1 and/or may include additional features (e.g., additional loops, handles, partitions, pockets and/or other features). Although the foregoing description of carrier 1 indicates that woven nylon can be used for many portions of carrier 1, numerous other materials and/or combinations of materials could be used. In some embodiments, a carrier may be made from a material having a camouflage pattern formed thereon. As another alternative, a carrier could be formed from a colored material that provides camouflage under certain conditions (e.g., black for night operations, white for arctic operations). Carriers according to various embodiments may also have sizes and/or shapes different from those described above.

In some embodiments, a carrier may include more than one panel or other elements that can be non-destructively separated from other carrier elements and then re-attached to those other elements so as to place the carrier in a closed condition. As but one example, panel 59 could be replaced by two or more panels.

In the above-described embodiments, zippers, cooperating hook and loop material strips, snaps, and side-release buckles are fastening components used to attach and non-destructively detach various elements of a carrier. Other embodiments may include different combinations of these devices. For example, one embodiment might utilize hook and loop material for attaching two components and another embodiment might use a zipper to attach those same components (or vice versa). Other types of non-destructively releasable fastening mechanisms can be used (e.g., other types of mechanical interlocks, magnetic connectors).

Although the above description of carrier 1 indicates that individual components can be assembled by stitching, attachment methods other than (or in addition to) stitching could be used. Such methods could include adhesive bonding, thermal bonding (e.g., RF welding), etc.

The foregoing description of embodiments has been presented for purposes of illustration and description. The foregoing description is not intended to be exhaustive or to limit embodiments to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. All embodiments need not necessarily achieve all objects or advantages identified above. Any and all permutations of various features described herein are within the scope of the invention. As used herein (including the claims), the terms "including" and "includes" are used in the open-ended sense similar to the words "comprising" and "comprises" (e.g., an article that includes a particular component may or may not also include additional components).

The invention claimed is:

1. A carrier configurable to hold at least one weapon during a parachute drop, the carrier comprising:

a main body, wherein the main body includes at least one panel that is attachable to at least one other portion of the main body to place the main body in a closed condition and is nondestructively detachable from the at least one other portion of the main body to place the main body in an open condition, the main body defines an internal storage region when the main body is in the closed condition, and the main body includes an open bottom end, a narrow region that includes the open bottom end, a top end opposite the bottom end, a broadened region that includes the top end, and a transitional region between the narrow and broadened regions;

an extension sleeve, wherein the extension sleeve is coupled to the main body and includes a pocket and a mouth exposing the pocket, at least a portion of the extension sleeve including the mouth rests within the internal storage region when the main body is in the closed condition, the extension sleeve is configured for extension from the main body through the open bottom end so as to create an expandable storage space that includes the internal storage region and extends into the pocket through the mouth, the expandable storage space has a length that varies, based on an amount by which the extension sleeve extends from the main body, to accommodate multiple types of weapons, and the extension sleeve and main body are configurable to adjustably limit the amount by which the extension sleeve extends from the body;

a parachute harness attachment connector positioned on an exterior portion of the main body at a location on or near the top end; and means for collapsing excess internal space of the main body in the broadened region when the main body is in the closed condition.

2. The carrier of claim 1, further comprising:

a pocket located in the internal storage region, wherein the pocket is positioned to hold at least a portion of a butt end of a weapon when the weapon is contained in the carrier and positioned with a muzzle of the weapon in the extension sleeve pocket.

3. The carrier of claim 2, wherein the extension sleeve includes one of hook or loop fastening material on outer surfaces and at least one interior region of the main body proximate the open bottom end includes the other of hook and loop fastening material.

4. The carrier of claim 3, wherein the extension sleeve includes a base, the base including a portion extending beyond and positioned adjacent the mouth, the base having a snag-resistant surface configured to confront a weapon when the weapon is placed into the expandable storage space.

5. The carrier of claim 4, further comprising a curtain having a first edge attached to the extension sleeve and a second edge attached to the main body, wherein the curtain is configured to prevent equipment stored in the internal storage region but not located in the pocket from escaping through the open bottom end.

6. The carrier of claim 3, wherein the extension sleeve and main body include at least one strap to adjustably limit the amount by which the extension sleeve extends from the body.

7. The carrier of claim 1, further comprising a weapon contained in the expandable storage space.

8. The carrier of claim 1, further comprising a curtain having a first edge attached to the extension sleeve and a second edge attached to the main body, wherein the curtain is configured to prevent equipment stored in the internal storage region but not located in the pocket from escaping through the open end.

9. The carrier of claim 1, wherein the extension sleeve includes loop fastening material on outer surfaces, wherein an interior region of the main body proximate the open end includes hook fastening material positioned to interact with different portions of the loop fastening material when the extension sleeve is withdrawn from the main body by different amounts, and further comprising a flap alternately positionable to cover or expose the hook fastening material.

10. The carrier of claim 1, further comprising a snag-resistant surface on an interior surface configured to confront a weapon when the weapon is contained in the internal storage region.

* * * * *